US011523232B2

(12) United States Patent
Nielsen et al.

(10) Patent No.: US 11,523,232 B2
(45) Date of Patent: Dec. 6, 2022

(54) WIRELESS BINAURAL HEARING DEVICE SYSTEM WITH ADAPTIVE CONTROL OF TRANSMISSION VOLTAGE

(71) Applicant: GN Hearing A/S, Ballerup (DK)

(72) Inventors: Ivan Riis Nielsen, Ringsted (DK); Brian Dam Pedersen, Ringsted (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/592,767

(22) Filed: Feb. 4, 2022

(65) Prior Publication Data

US 2022/0264235 A1 Aug. 18, 2022

(30) Foreign Application Priority Data

Feb. 16, 2021 (DK) ..... PA202170072

(51) Int. Cl.
*H04R 25/00* (2006.01)

(52) U.S. Cl.
CPC ..... *H04R 25/554* (2013.01); *H04R 25/603* (2019.05); *H04R 2460/07* (2013.01)

(58) Field of Classification Search
CPC ..... H04R 25/554; H04R 25/603; H04R 2460/07
USPC ..... 381/312
See application file for complete search history.

(56) References Cited

U.S. PATENT DOCUMENTS 9,313,577 B2 * 4/2016 Bodvarsson ..... H04R 5/033
2004/0247148 A1 12/2004 Pedersen
2007/0274550 A1 11/2007 Baechler et al.
2008/0226107 A1 9/2008 Boguslavskij et al.
2010/0054512 A1 3/2010 Solum
2010/0184383 A1 7/2010 Lerke
2014/0003636 A1 * 1/2014 Bodvarsson ..... H04R 5/033 381/311

(Continued)

FOREIGN PATENT DOCUMENTS

DE 102007011841 9/2008
EP 3386216 10/2018

OTHER PUBLICATIONS

Technical examination report dated May 18, 2021 for Danish patent application No. PA 202170072.

(Continued)

*Primary Examiner* — Phylesha Dabney
(74) *Attorney, Agent, or Firm* — Vista IP Law Group, LLP

(57) ABSTRACT

A system includes: first and second hearing devices, each hearing device comprising an output transducer, a wireless communication unit, an antenna, and a power supply having primary and secondary voltage sources, wherein the secondary voltage source provides a lower voltage than the primary voltage source; and a detector arrangement to provide a quality indicator indicative of a quality of a wireless link between the first and second hearing devices, wherein each of the first and second hearing devices comprises a control unit configured to operate the respective hearing device in: when the quality indicator is above a threshold, a first power mode in which the respective hearing device uses its secondary voltage source to drive transmission with its antenna, and when the quality indicator is below the threshold, a second power mode in which the respective hearing device uses its primary voltage source to drive transmission with its antenna.

20 Claims, 8 Drawing Sheets

(56) References Cited

U.S. PATENT DOCUMENTS

2014/0307901 A1 10/2014 Ku et al.

OTHER PUBLICATIONS

Technical examination report with intention to grant dated Sep. 16, 2021 for Danish patent application No. PA 202170072.
Extended European Search Report for EP Patent Appln. No. 22154001.6 dated Jun. 30, 2022.

* cited by examiner

WIRELESS BINAURAL HEARING DEVICE SYSTEM WITH ADAPTIVE CONTROL OF TRANSMISSION VOLTAGE

RELATED APPLICATION DATA

This application claims priority to, and the benefit of, Danish Patent Application No. PA 2021 70072 filed on Feb. 16, 2021. The entire disclosure of the above application is expressly incorporated by reference herein.

FIELD

The present disclosure relates to a wireless binaural hearing device system comprising two wirelessly connected hearing devices with adaptive control of transmission voltage. Further, the disclosure relates to a method of adaptively operating the transmission voltage in a wireless binaural hearing device system. Further, the disclosure relates to a hearing device with adaptive control of transmission voltage.

BACKGROUND

In wireless binaural hearing device systems, which comprises two wirelessly connected hearing devices, such as in-ear headphones, hearing aids, or cochlear devices, wireless data communication between the two hearing devices is essential for proper operation. For the hearing devices to function optimally it is important that they can maintain a stable wireless link between them.

In wireless binaural hearing devices, there are many factors that can affect the wireless link quality when the hearing devices are placed on a user. Head and ear shape determine the distance between the hearing devices and the alignment of the antennas. It is therefore difficult to predict the link quality before the hearing devices are placed on a user and operated.

For this reason, hearing devices are usually given an over dimensioned wireless link energy budget. This ensures a certain link quality regardless of the head shape of the user or external factors, such interference or clock drift etc. This excess energy budget does however require a larger amount of energy to maintain and therefore reduces the operational time, i.e., time between recharging or battery replacement. In the prior art a solution to this is achieved by using dynamical transmission strength by providing hearing devices capable of turning down the transmission strength when the wireless link quality allows it.

US 2008/0226107 A1 relates to a transmission method for the inductive transmission in hearing devices and hearing device accessories by transmitting a signal from a transmitter to a receiver with a specific transmission power.

EP 2211579 A1 relates to a communication system comprising a first and a second communication device, each comprising transmit and receive units for establishing a wireless link between the devices. Wherein at least the first communication device comprises a control unit for dynamically adjusting the transmit power of it transmit unit based on a measure of the quality of the link.

US 2010/0054512 A1 relates to various system embodiments comprising a plurality of devices adapted to wirelessly communicate with each other. The plurality of devices includes a battery-operated hearing assistance device adapted to be worn by a person. The hearing aid device includes a signal processing circuitry connected to a microphone and a receiver. At least one of the plurality of devices includes a link quality management device adapted to assess a link quality for a first wireless communication channel, provide channel metrics indicative of the assessed quality for the first wireless communication channel, and adjust wireless communication over the first wireless communication channel using the channel metrics for the first wireless communication channel.

A problem in the prior art is that data packages risk being lost due to insufficient link quality following a reduction in transmission power. Thus, there is a need in for wireless hearing devices with improved power management which overcomes this problem.

SUMMARY

A first aspect relates to a wireless binaural hearing device system comprising: a first and a second hearing device for placement at and/or in a user's first and second ear, respectively, each hearing device comprising an output transducer for providing an output to the user, a wireless communication unit and an antenna adapted for providing a wireless link between the first and the second hearing devices, an amplifier configured for amplifying signals received via the wireless link according to a gain level, and a power supply having a primary voltage source and a secondary voltage source, wherein the secondary voltage source provides a lower voltage than the primary voltage source; and a detector arrangement adapted for determining a quality indicator indicative of the quality of the wireless link; a control arrangement adapted to: switch to a low power mode when the quality indicator is above a threshold, in which a transmitting hearing device of the first and second hearing devices uses its secondary voltage source to drive transmission with its antenna, and synchronously increase the gain level of a receiving device of the first and second hearing devices; and switch to a regular power mode when the quality indicator is below the threshold, in which regular power mode the transmitting hearing device uses its primary voltage source to drive transmission with its antenna, and preferably synchronously decrease the gain level of the receiving device.

A second aspect relates to a method of operating a wireless binaural hearing device system comprising a first and a second hearing device for placement at and/or in a user's first and second ear, respectively, each hearing device comprising an output transducer for providing an output to the user, a wireless communication unit and an antenna adapted for providing a wireless link between the first and the second hearing devices, an amplifier configured for amplifying signals received via the wireless link according to a gain level, and a power supply having a primary voltage source and a secondary voltage source, wherein the secondary voltage source provides a lower voltage than the primary voltage source, the method comprising the steps of: determining a quality indicator indicative of the quality of the wireless link; and switching to: a low power mode when the quality indicator is above a threshold, in which a transmitting hearing device of the first and second hearing devices uses its secondary voltage source to drive transmission with its antenna, and synchronously increase the gain level of the amplifier of a receiving device of the first and second hearing devices, or a regular power mode when the quality indicator is below the threshold, in which regular power mode the transmitting hearing device uses its primary voltage source to drive transmission with its antenna, and preferably synchronously decrease the gain level of the amplifier of the receiving device.

A third aspect relates to a wireless hearing device adapted for placement at and/or in a user's ear, the hearing device comprising: an output transducer for providing an output to the user; a wireless communication unit and an antenna adapted for providing a wireless link between the hearing device and an external device; an amplifier configured for amplifying signals received via the wireless link according to a gain level; a power supply having a primary voltage source and a secondary voltage source, wherein the secondary voltage source provides a lower voltage than the primary voltage source; a detector unit adapted for determining a quality indicator indicative of the quality of the wireless link; and a control unit adapted to operate the hearing device in:

when the quality indicator is above a threshold, a low power mode in which the secondary voltage source is used to drive transmission with the antenna, and when the quality indicator is below the threshold, a regular power mode in which the primary voltage source is used to drive transmission with the antenna, wherein the hearing device is adapted for, before switching to the low power mode, transmitting a switching signal comprising information of the switch to low power mode via the wireless link, and preferably adapted for, before switching to the regular power mode, transmitting a second switching signal comprising information of the switch to regular power mode via the wireless link.

The external device may be another hearing device adapted for placement at and/or in the user's opposite ear. The external device may be a smart phone or a spouse microphone or a hearing aid accessory.

In this context, synchronously is to be understood as substantially simultaneously. To this end, the hearing device system will have to inform both hearing devices, or the hearing device and the external device, about an upcoming change in power mode so that the hearing devices may time when changing power mode, i.e., changing power source at the transmitting device and gain level at the receiving device. As the following description will make clear, this can be solved in several ways, all falling within the scope of the invention.

Thus, when a hearing device of the present disclosure does not require the full link budget to transmit successfully, either because the antennas of the first hearing device and the second hearing device or external device are sitting close together, there are less noise/interference, or better alignment, it is possible to drive the antenna using a lower voltage, i.e. the secondary voltage source. It is an advantage that a switch to low power mode and preferably also to regular power mode not only comprise changing the transmission strength at the transmitting hearing device of the two hearing devices but also adjusting a gain setting of the amplifier of the receiving hearing device of the two hearing devices synchronously, i.e. stepping down the gain setting when switching to regular power mode and, in particular, stepping up the gain setting when switching to low power mode, thereby preventing that transmitted data packages could get lost because the gain setting of the receiving side's amplifier is set to low for signals transmitted in low power mode.

By determining, based on a quality indicator of the wireless link, which voltage source should be used to drive transmission of the respective antennas, the hearing devices may reduce power consumption by avoiding transmitting wireless signals at a power greater than needed for the wireless signals to reach the opposite hearing device. Furthermore, by continuously monitoring the wireless signal quality with the detector arrangement, the hearing devices may adaptively switch between the power modes should conditions change.

The wireless link allows for bidirectional communication. Thus, the first and second hearing device(s) may both act as the transmitting hearing device and the receiving hearing device. The hearing devices may be adapted for using time-division multiplexing (TDM) when communicating via the wireless link, so that the first and second hearing devices alternate between being the transmitting and receiving hearing device. When using TDM the time domain is divided into several recurrent time slots of fixed duration, i.e. frames, wherein the first and second hearing devices takes turns being the transmitting and receiving hearing device, and alternates in subsequent time slots. Thus, a hearing device will be the transmitting device during its transmission (TX) slot/frame and the receiving device during its receiving (RX) slot/frame.

The hearing device(s) may be wireless earbuds. The hearing device(s) may be hearing aids. Hearing aids are hearing devices comprising one or more microphones for providing an electrical input signal representing ambient sound, a signal processor adapted for processing the electrical input signal by compensating for a hearing loss of a user to provide an electric output signal, and an output transducer for converting the electric output signal to signal perceivable by the user. The hearing device(s) may be cochlear devices. The output transducer(s) may be loudspeakers adapted for providing an acoustic output. The output transducer(s) may be cochlear implants adapted for providing an electric stimulation output.

In one or more embodiments, the antennas of the first and second hearing devices are magnetic antennas, i.e., a coil adapted for near-field magnetic induction (NFMI) communication. The adaptive voltage control scheme of the present invention is particularly advantageous with NFMI antennas as the power density of near-field transmissions is extremely restrictive and attenuates at a rate proportional to the inverse of the range to the sixth power. The magnetic antenna may comprise a coil. The coil may be wound around a magnetic core. The magnetic antenna may be adapted for transmission and reception at a frequency between 1 MHz and 100 MHz, preferably between 5 MHz and 30 MHz, more preferably between 10 MHz and 15 MHz.

In one or more embodiments, the power supply of each hearing device comprises a battery providing a third voltage. The batteries may be rechargeable. The batteries may be a Zinc-air battery. The voltage of the first voltage source may be greater than the third voltage. The primary voltage source may comprise a voltage multiplier, preferably a voltage doubler. The voltage of the primary voltage source or the second voltage source may be equal to the third voltage ±10%, preferably equal to the third voltage. The secondary voltage source may comprise a buck converter or a step-down transformer.

In one or more embodiments, one or both hearing device(s) comprise(s) a secondary antenna adapted to provide a secondary wireless link with a secondary external device e.g., a smart device, a smart phone, or a spouse mic, etc. The secondary antenna may be an electric antenna, such as a loop antenna, a patch antenna, a monopole antenna, or a dipole antenna. The secondary antenna may be adapted for transmission and reception at a frequency between 0.9 GHz and 6 GHz. The secondary antenna may be an antenna adapted for communication at an ISM-frequency, such as 915±13 MHz, 2.45±0.05 GHz, 5.8±0.075 GHz. The secondary antenna may also be driven by the primary or secondary voltage source.

In one or more embodiments, the hearing device(s) comprises an input transducer, such as a microphone, adapted to convert incoming sound to a corresponding electric input signal. The hearing device(s) may comprise a signal processing unit adapted for providing an electric output signal based on the electric input signal and/or signals received through the wireless link and/or signals received through the secondary wireless link. The output transducers may be adapted to convert the electric output signal to the output. The signal processing unit(s) may be adapted to compensate for a hearing loss of the user, i.e. apply frequency dependent gain depending on the frequency specific hearing loss of the user. Thereby, the output may be based on ambient sound, or audio data streamed from the wireless link and/or the secondary wireless link, or any combination of these.

The detector arrangement may comprise a first detector unit located in the first hearing device. In one or more embodiments, the detector arrangement comprises a second detector unit located in the second hearing device. The adaptive voltage control may be realized by one detector unit located in the first hearing device. In such embodiments, the first hearing device provides a switching signal comprising the quality indicator and/or instruction data to the second hearing device via the wireless link, such that the second hearing device may determine which power mode to operate in. The advantage of this approach is that the electronics of the second hearing device may be simplified as it does not require a detector unit. Alternatively, both hearing devices may comprise a detector unit such that each hearing device may determine a quality indicator and the respective control units may determine which mode to operate in based on the quality indicator provided by its local detector unit.

Each of the hearing devices comprise an amplifier configured for amplifying signals received via the wireless link according to a gain level of the amplifier. The amplifier may comprise more than 2 gain levels, preferably more than 10. The detector unit may be arranged downstream of the amplifier. The detector unit may be adapted to provide a feedback control signal to the amplifier. By providing the hearing device(s) with an amplifier the received signal strength may be kept at a more constant level, thereby providing a more stable wireless link and a better basis for the detector unit to determine the quality indicator. By adapting the detector unit to provide a feedback signal to the amplifier the gain level may be set by the detector unit according to the strength of the amplified received signals, thereby allowing the amplifier to maintain a more stable level of the outputted signals.

In one or more embodiments, the hearing device(s) comprises an analogue to digital converter (ADC). The ADC of a hearing device may be arranged downstream, i.e., connected to, and arranged later in the signal path, of the amplifier of that hearing device. The ADC of a hearing device may be arranged upstream, i.e. connected to, and arranged before in the signal path, of the detector unit of that hearing device. The ADC(s) may have a resolution of 2 or more bits. It is particularly useful to provide an ADC with a resolution of 2 or more bits before the detector unit as this will ensure a more accurate estimate of the wireless signal quality and therefore better operation of the hearing device(s).

In one or more embodiments, the hearing device(s) is/are adapted to switch to operating in the regular power mode when no signal has been received for a preset period of time. The advantage this is that if the hearing device(s) cannot maintain the wireless link at sufficient strength in the low power mode, and therefore cannot determine a quality indicator they will automatically switch to the regular power mode. The preset period of time may be one time slot.

In one or more embodiments, the detector arrangement is adapted to determine the quality indicator based on one or more of the gain level(s) of one or both of the amplifiers, a signal strength of a wireless signal received by an antenna, a bit-error rate in a received signal, a signal strength after amplification by the amplifier, an output of the ADC, a frame-error rate in a received signal, or any combination hereof.

In one or more embodiments, the hearing device(s) is/are adapted to transmit a switching signal via the wireless link, the switching signal comprising at least one of:

quality data including and/or based on the quality indicator, instruction data comprising instructions to switch to the low power mode or the regular power mode or to change the gain level, or countdown data indicating the timing of an upcoming switch in power mode.

The switching signal allows the synchronous operation of the transmitting hearing device's antenna driver, i.e. which of the primary or secondary power source is used to drive the antenna, and the receiving hearing device's amplifier. A receiving device of the devices, i.e. the hearing devices or the external device, may determine the quality indicator, then, when it becomes said receiving hearing device turn to assume the role as the transmitting device, transmit the data required for the opposite hearing device to perform a synchronous switch in power mode/gain level. To this end, quality data can inform the receiving device about the signal quality.

The hearing device(s) may be adapted to during at least a fraction of its/their TX frames to transmit switching data indicating an upcoming switch in power mode and/or which power mode should be used in a subsequent time frame, such as at least 10% of the TX frames, such as at least 25% of the TX frames, such as at least 50% of the TX frames, such as at least 75% of the TX frames, such as at least 90% of the TX frames, such as 100% of the TX frames. The countdown data may indicate how many time frames should pass before an upcoming switch in power mode.

The instruction data may comprise information data informing the receiving hearing device that the transmitting hearing device will switch voltage source, i.e. between the primary and the secondary voltage source, so that the receiving hearing device can set the gain level of its amplifier accordingly. The instruction data may comprise data instructing the receiving hearing device to switch voltage source, i.e. between the primary and the secondary voltage source, for an upcoming transmission from the receiving hearing device, i.e. when the hearing devices alternates between being the receiving and transmitting hearing device. Thus, the instruction data allows a currently receiving hearing device to switch between its primary and secondary voltage source in one of its upcoming transmission slots.

The hearing devices may be configured such that an upcoming switch between low power mode and regular power mode is implemented at a preset timing. However, in a preferred embodiment the switching signal comprises countdown data which allows synchronization between a transmitting hearing device switching voltage source and a receiving hearing device setting its gain level accordingly. This enables more precise timing of the synchronized switch in power mode. The countdown data may indicate how many time slots must pass before switching power mode. When transmitting the switching signal multiple times, the countdown data is updates for each transmission so that it correctly indicates the timing of the upcoming switch. In a preferred embodiment, the countdown data comprises two or more bits. this allows the countdown data to carry more data so that it can signal further in advance of an upcoming switch. Particularly, when the switching signal is transmitted multiple times, countdown data comprising two or more bits allows more countdowns. An advantage of this is that the receiving hearing device only needs to receive one, i.e., it can miss some of the switching signals, and still achieve a synchronous switch of power mode.

When using TDM, the countdown bits may indicate how many time slots should pass before a hearing device should act on a received switching signal. The countdown data may include 2 to 4 countdown bits, preferably 3 countdown bits. This will allow a hearing device wanting the opposite hearing device to change power mode and/or to inform the opposite hearing device that the hearing device is changing power mode so the opposite hearing device can change the gain level accordingly to signal this several frames ahead, i.e. $2^N$, where N is the number of countdown bits.

When using TDM, one or both hearing device(s) may be adapted to transmit one or more information bit(s) indicating which power mode that hearing device will be in in a subsequent of its transmission (TX) frames. This allows the opposite hearing device to set the gain level of its amplifier according to the information bit, i.e. higher gain level if it is to receive signals from a hearing device that is transmitting in low power mode and lower gain level if it expects to receive signals from a hearing device that is transmitting in high power mode. One or both hearing device(s) may be adapted to transmit one or more control bit(s) indicating which power mode the opposite hearing device should operate in for a subsequent of the opposite hearing device's TX frames. This allows a respective hearing device to set the gain level of its amplifier according to the control bit as it will know which power mode the opposite hearing device will transmit in. Preferably, the information and/or control bits are mirrored, i.e., transmitted multiple times, to avoid lost bits. Preferably, the information and/or control bits are transmitted three times, thereby allowing data verification without taking too much bandwidth.

In some embodiments, the hearing device(s) may be adapted so that when it/they receive a switching signal in a reception (RX) frame the control unit sets the power mode according to the control signal at a predetermined TX frame after that RX frame, e.g., the $1^{st}$ $2^{nd}$, or $3^{rd}$, etc. TX frame after that RX frame. The hearing device(s) may be adapted so that when it/they receive the information signal in a first RX frame the control unit sets the gain level of the amplifier according to the control signal at a predetermined second RX frame after the first RX frame, e.g., the $1^{st}$ $2^{nd}$, or $3^{rd}$, etc. RX frame after the first RX frame.

By using TDM and providing one or both hearing device(s) the ability to transmit control and/or information bits synchronization of changes to gain levels and power mode may be done more simple as the synchronization signal may be implicitly shared between the hearing devices, as the hearing devices can infer that they should act according to the control and/or information bits in a subsequent time frame. Alternatively, the synchronization signal may include information on how many frames should pass before a hearing device should act on received control and/or information signals.

In one or more embodiments, the hearing device system may be adapted to integrate the quality indicator over multiple time frames, i.e. 2 or more. The hearing device system may be configured to the low power mode only when the quality indicator has been above the threshold for multiple consecutive time frames.

In one or more embodiments, the threshold depends on which power mode the respective hearing device is operated in. The threshold may be lower when the hearing device is operated in the low power mode than when the hearing device is operated in the regular power mode. In one or more embodiments, the control unit may be adapted to switch to the regular power mode and/or increase the gain level of the amplifier when the hearing device has not received any signals via the wireless link for a period of time. This will increase the requirements to the quality of the wireless link when the hearing device(s) is in low power mode and ensure that the hearing device reverts to the regular power mode if switches to the low power mode causes the wireless link to fail. Furthermore, it can also be used to prevent excessive switching between mode as it will introduce some hysteresis into the variable adaptation when the quality indicator floats around the threshold.

DETAILED DESCRIPTION

Figure 1:
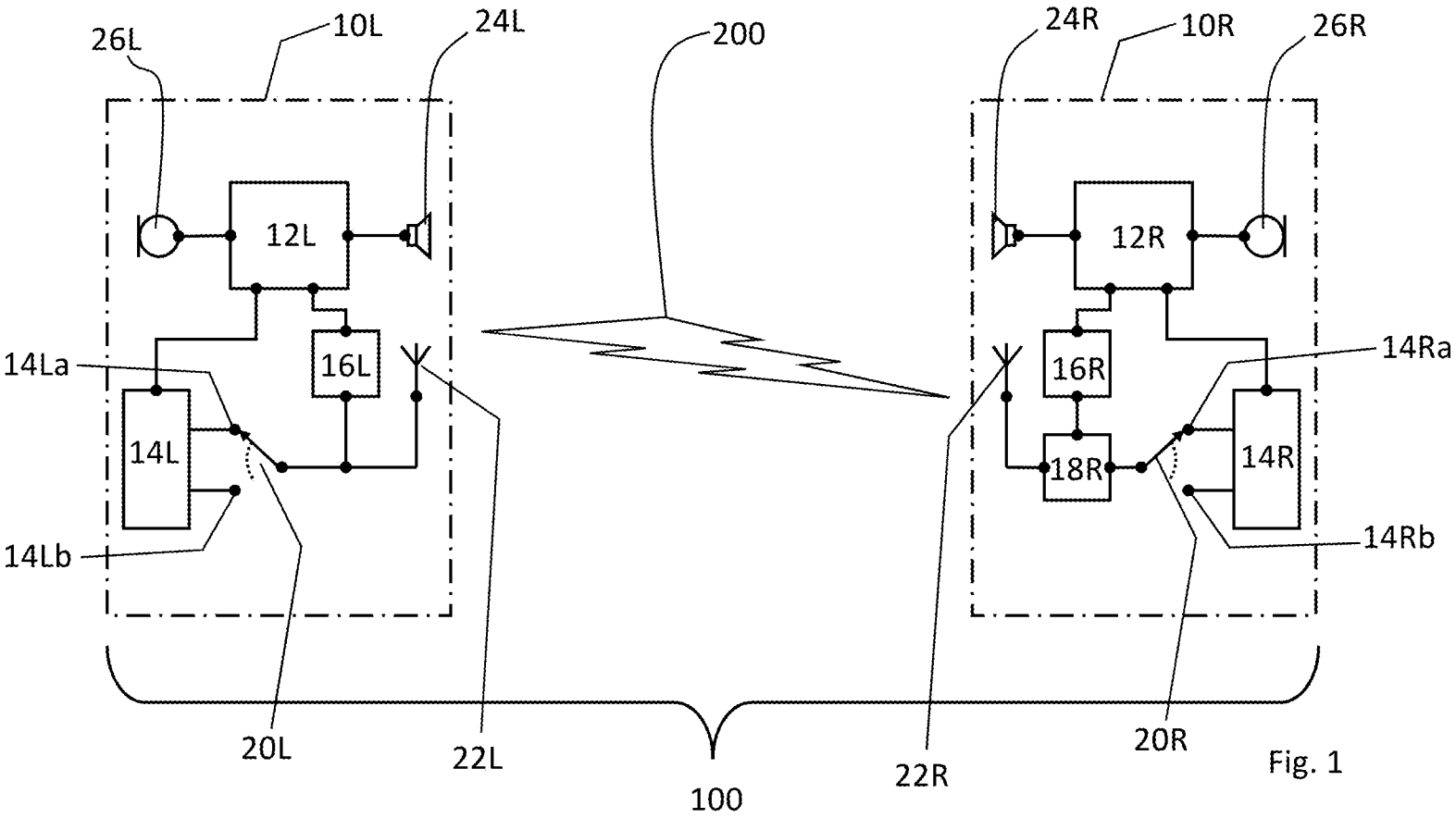
FIG. 1 shows a schematic illustration of a wireless hearing device system in accordance with exemplary embodiments.

In the following various exemplary embodiments of the present binaural hearing aid system are described with reference to the appended drawings. The skilled person will understand that the accompanying drawings are schematic and simplified for clarity and therefore merely show details which are essential to the understanding of the invention, while other details have been left out. Like reference numerals refer to like elements throughout. Like elements will, thus, not necessarily be described in detail with respect to each figure.

FIG. 1 shows a schematic illustration of a wireless hearing device system 100 comprising a first hearing device 10R and a second hearing device 10L wirelessly connected to each other via a wireless link 200. The wireless link 200 is used to share data between the first and second hearing devices 10R, 10L, such as audio data or system data. Each of the first and second hearing devices 10R, 10L comprise a signal processing unit 12R, 12L for processing an electric input signal and providing an electrical output signal. Each of the first and second hearing devices 10R, 10L comprise an output transducer 24R, 24L for converting the electric output signal to an output which can be sensed by a user.

In most applications, the output transducers 24R, 24L will be in the form of a receiver, i.e. a loudspeaker, adapted for converting the electrical output signal to an audible output which, when the hearing devices 10R, 10L are in use, will be provided to the respective ear canals of the user. In some applications, the output transducers 24R, 24L will be provided by cochlear implants, which are surgically implanted neuroprosthetic devices adapted to provide a user a sense of sound by bypassing the normal acoustic hearing process by directly electrically stimulating the auditory nerve. Each of the hearing devices 10R, 10L of the shown embodiment further comprise an input transducer in the form of a microphone arrangement 26R, 26L, each microphone arrangement 26R, 26L comprising at least one microphone. If the hearing devices 10R, 10L are hearing aids, the input transducers allow the hearing devices 10R, 10L to capture ambient acoustic signals and convert them into an electric input signal. If the hearing devices 10R, 10L are two wireless earbuds of a headset the input transducers allow the hearing devices 10R, 10L to capture acoustic signals, such as speech for phone calls or ambient sound to be presented in the output transducers 24R, 24L to give the user more ambient awareness.

Each of the first and second hearing devices 10R, 10L comprise a power supply 14R, 14L adapted for powering the respective hearing devices 10R, 10L. The power supply 14R, 14L will in most applications be provided by a rechargeable or replaceable battery but may in some application be provided by a fuel cell. Each power supply 14R, 14L has a primary voltage source 14Ra, 14La and a secondary voltage source 14Rb, 14Lb. Each respective primary voltage source 14Ra, 14La provides a higher voltage than the corresponding secondary voltage source 14Rb, 14Lb.

Each of the first and second hearing devices 10R, 10L comprise a wireless communication unit 16R, 16L capable of modulating/demodulating wireless communication signals, such as a radio. To transmit/receive the wireless communication signals, each of the first and second hearing devices 10R, 10L comprise an antenna 22R, 22L. Through these the hearing devices 10R, 10L can maintain a wireless link 200 for wireless communication between the hearing devices 10R, 10L. The antennas 22R, 22L may be provided by electrical antennas such as loop antennas, monopole antennas, dipole antennas, etc. or by magnetic antennas, i.e., a coil for magnetic near-field induction (NFMI) communication.

The hearing device system 100 further comprises a detector arrangement 18 adapted to evaluate the quality of the wireless link 200 and provide a quality indicator indicative of the wireless link quality. In FIG. 1, the detector arrangement 18 is provided by a detector unit 18R in the first hearing device 10R. The hearing device system 100 further comprises a control arrangement 20. The control arrangement 20 comprises a control unit 20R located in the first hearing device 10R and a control unit 20L located in the second hearing device 10L.

The control arrangement 20 is adapted for, based on the quality indicator, driving the respective antenna 22R, 22L, when transmitting, with the primary voltage source 14Ra, 14La or secondary voltage supply 14Rb, 14Lb. If the quality indicator is above a threshold, i.e., the wireless link 200 is strong, the control arrangement 20 will switch to a low power mode, where transmission is driven by the secondary voltage sources 14Rb, 14Lb. This will reduce power consumption of the hearing devices 10R, 10L at the cost of signal strength of the wireless link 200. However, if the wireless link 200 can be maintained at an acceptable quality using the secondary voltage sources 14Rb, 14Lb, this will be an acceptable tradeoff. On the other hand, if the quality indicator is below the threshold, i.e., the wireless link 200 is weak, the control arrangement 20 will switch to a regular power mode, where transmission is driven by the primary voltage sources 14Ra, 14La.

In the embodiment of FIG. 1, only the first hearing device 10R is provided with a detector unit 18R. As will be shown in later embodiments, the detector arrangement 18 may comprise a detector unit 18R, 18L in both the first and second hearing devices 10R, 10L. This is however not essential as a detector unit 18R located in the first hearing device 10R can evaluate the wireless link quality and provide the quality indicator to the control unit 20L of the second hearing device 10L via the wireless link 200.

In the embodiment shown in FIG. 1, each of the first and second hearing devices 10R, 10L comprise an input transducer 26R, 26L for providing the electric input signal. In most applications, the respective input transducers 26R, 26L will be provided by microphone arrangements, i.e., one or more microphones, in each hearing device 10R, 10L adapted for converting incoming audio input to a corresponding electric signal, i.e., the electric input signal. Alternatively, the electric input signal may be provided wirelessly, through the wireless link 200 between the first and second hearing devices 10R, 10L or through a secondary wireless link with an external device, e.g. an external microphone, a smartphone or other smart device.

Figure 2:
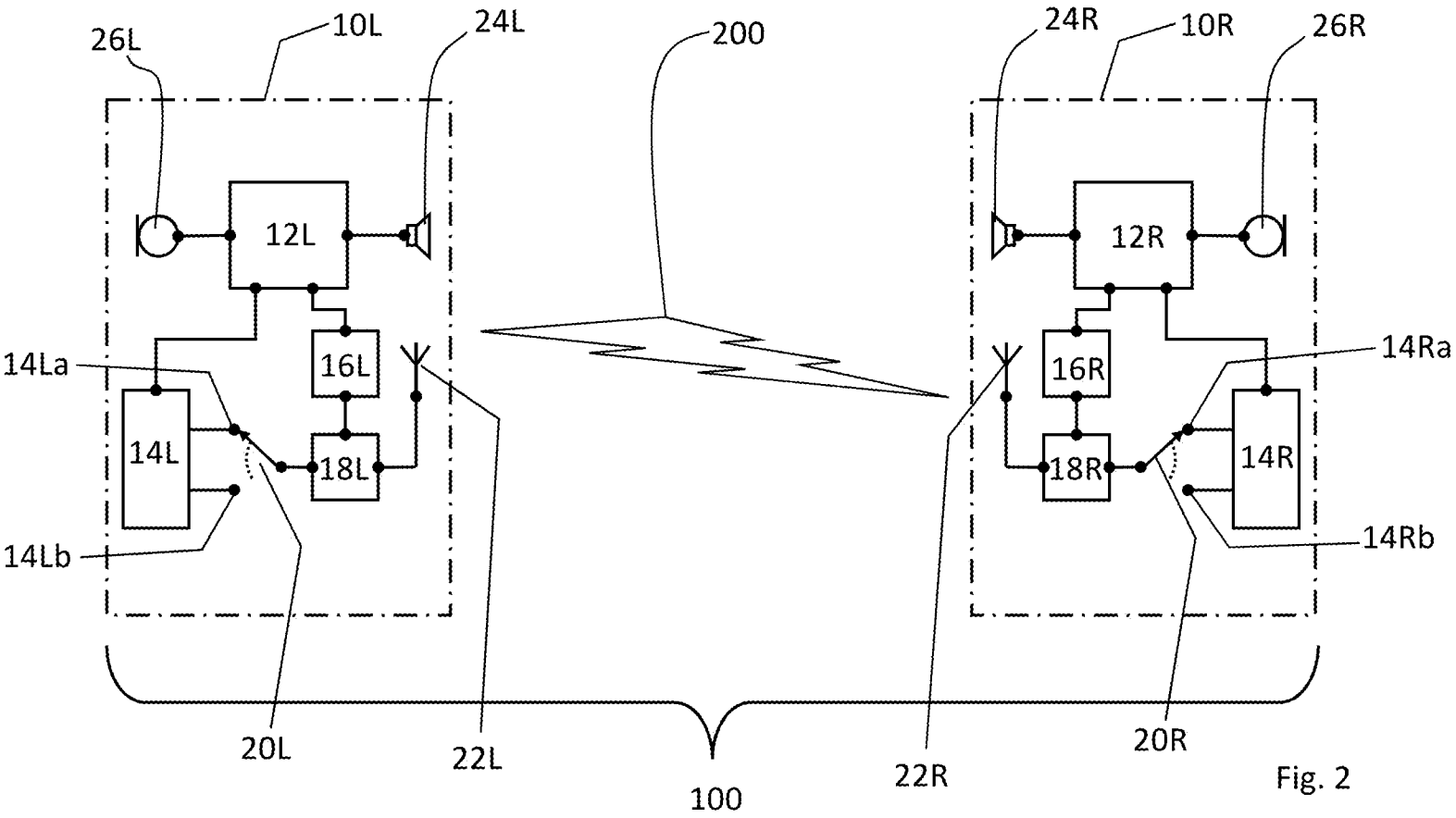
FIG. 2 shows a schematic illustration of a wireless hearing device system in accordance with exemplary embodiments.

FIG. 2 shows a wireless hearing device system 100 similar to the one shown in FIG. 1. In the shown embodiment, the detector arrangement comprises a detector unit 18R, 18L in each of the hearing devices 10R, 10L. By providing each of the hearing devices 10R, 10L with a detector unit 18R, 18L, the detector arrangement may detect the local conditions at each hearing device 10R, 10L. If conditions allow for it, it may be possible for asynchronous control of the first hearing device 10R and the second hearing device 20L, i.e., one may be operated in the regular power mode while the other is operated in the low power mode. This will be advantageous under conditions where one hearing device experience a higher interference/noise than the other.

Furthermore, by providing each of the hearing devices 10R, 10L with a detector unit 18R, 18L, the hearing device system 100 may adapt to changes in the wireless link 200 quicker and more efficiently. This is particularly so if the wireless hearing device system 100 is using time-division multiplexing (TDM), where each hearing device 10R, 10L is allocated non-overlapping time frames for transmission and reception, respectively. The detector unit of a respective hearing device may determine the quality indicator based on a gain level of the amplifier of that hearing device, i.e. high amplification meaning low wireless link quality. To this end, and initial setting of the gain level may be determined from the received signal strength, bit-error rate and/or similar.

Figure 3:
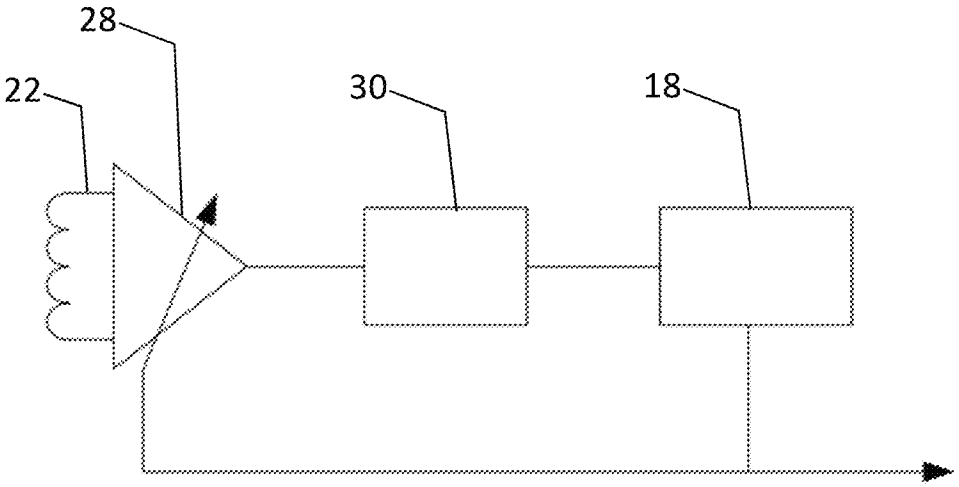
FIG. 3 shows an illustration of the hearing device(s) transmission (TX) system in accordance with exemplary embodiments.

FIG. 3 shows the reception (RX) system of a hearing device 10 according to some embodiments, i.e., the first and/or the second hearing device 10R, 10L. The RX system comprises the antenna 22, which in the shown embodiment is a magnetic antenna, i.e., a coil configured for magnetic induction communication, and the detector unit 18. The detector unit is connected to the antenna 22 so that it may detect the quality of the wireless link 200 and provide a quality indicator.

In the shown embodiment, the RX system comprises an amplifier 28, the amplifier 28 being adapted to amplify signals received via the wireless link 200 according to a gain level of the amplifier. The gain levels may either be continuous or discrete. When the gain levels are discrete, there is preferably more than two, even more preferably more than 10. The quality indicator may be based on one or more of a received signal strength, the gain level of the amplifier 28, and a bit error rate. The detector unit 18 is arranged in a feedback loop with the amplifier 28, so that the gain level of amplifier 28 may be controlled by the detector unit 18.

The shown embodiment further comprises an analogue to digital converter (ADC) 30 connected to the amplifier 28, downstream from the amplifier 18 in the RX signal path, and to the detector unit 18, upstream from the detector unit 18 in the RX signal path. The ADC 30 is adapted to convert the received analogue, amplified signals into a digital signal. The ADC 30 preferably has a resolution of 2 or more as this provides the detector unit 18 with more information on the received signals, whereby adaptive switching between low and regular power mode is improved.

After evaluation by the detector unit 18, the digital signal is passed on the wireless communication unit 16 (not shown in FIG. 3). The detector unit 18 may be incorporated in the wireless communication unit 16 or receive information on bit errors from the wireless communication unit 16 so that the information may be used to determine the quality indicator.

Figure 4:
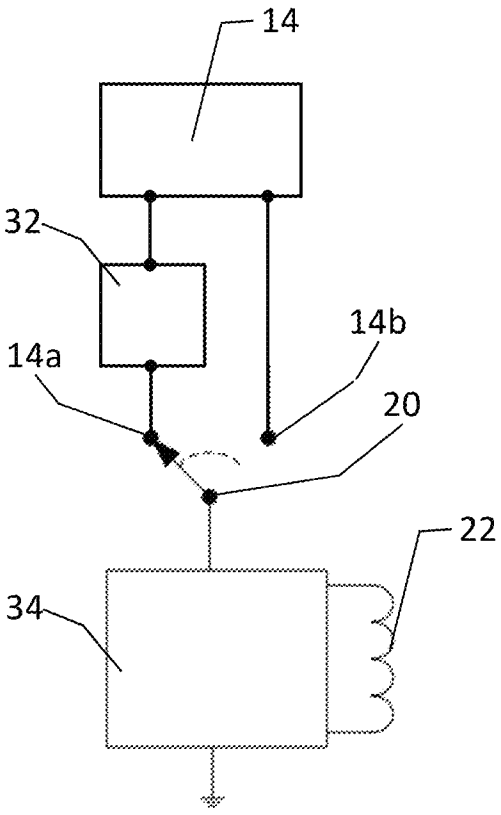
FIG. 4 shows an illustration of the hearing device(s) reception (RX) system in accordance with exemplary embodiments.

FIG. 4 shows the transmission (TX) system of a hearing device 10 according to some embodiments, i.e., the first and/or the second hearing device 10R, 10L. In the shown embodiment, the antenna 22 is provided by a magnetic antenna, i.e., a coil, connected to an antenna driver 34. The antenna driver 34 is used to drive the antenna 22 during transmission. Although the RX and TX systems may comprise their own individual antenna, most applications will see them sharing one common antenna 22. To provide power for the antenna 22, and the hearing device 10 in general, the hearing device comprise a power supply 14. The power supply 14 will in most embodiments be provided by a one-time use battery or a rechargeable battery, but it can also be in the form of a fuel cell.

The power supply 14 comprises two voltage sources 14*a*, 14*b*, a primary voltage source 14*a* and a secondary voltage source 14*b*. The primary voltage source 14*a* provides a higher voltage than the secondary voltage source 14*b*, which means that the antenna 22 can transmit a stronger signal when driven by the primary voltage source 14*a*. In the shown embodiment, the primary voltage source 14*a* comprises a voltage multiplier 32, e.g., a voltage doubler or an alternative voltage increaser, e.g., a DC/DC step-up converter or a switch mode converter, while the secondary voltage source 14*b* is connected directly to the power supply 14. Thereby, the voltage of the secondary voltage supply 14*b* is equal to that to the power supply 14/battery, while the primary voltage source 14*a* has a higher voltage.

Alternatively, the primary and the secondary voltages sources 14*a*, 14*b* could be provided by a switch mode converter capable of providing a variable voltage output or the primary voltage source 14*a* could comprise voltage increaser, e.g., a voltage multiplier, and the secondary voltage source 14*b* could comprise a voltage decreaser. Alternatively, the if the voltage of the power supply 14 is greater than needed for the secondary voltage source 14*b* the secondary voltage source 14 could comprise a voltage decreaser and the primary voltage source 14*a* could be coupled directly to the power source 14.

The coil driver 34 is connected to a control unit 20, which based on the quality indicator from the detector unit 16 determines whether the hearing device 10 should be operated in a regular power mode, in which the antenna driver 34 is connected to the primary voltage source 14*a*, or low power mode, in which the antenna driver 34 is connected to the secondary voltage source 14*b*. The TX system is coupled to the wireless communication unit 16 (not shown in FIG. 4) which feeds the signal to be transmitted to the antenna 22.

Figure 5:
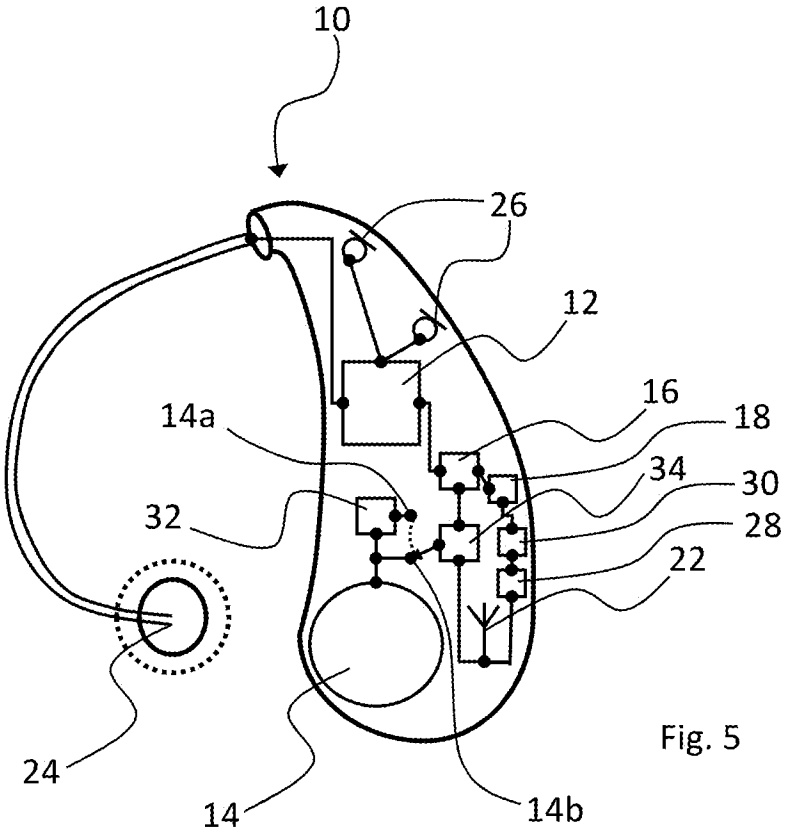
FIG. 5 shows a schematic illustration of a hearing aid in accordance with exemplary embodiments.

FIG. 5 shows an illustration of a hearing device 10 in accordance with some embodiments. The shown hearing device 10 is a Behind-The-Ear (BTE) hearing aid comprising a BTE part. Although the shown embodiment depicts a BTE hearing aid, the content of this document also applies to other types of hearing aids, such as hearing aids for placement in the ear canal of the user, or other portable hearing devices for placement at the ears of the user, such as ear buds, also known as in the ear head phones. The shown BTE hearing aid is of the type where the output transducer 24 is located in an In-The-Ear (ITE) part.

The hearing device 10 comprises two input transducers 26 in the form of two microphones, which are configured to capture the sound of the user's environment an create microphone signals representing the captured sound. The hearing device 10 further comprises a wireless communication unit 16 with a transmitter-receiver pair or transceiver for modulating signals for transmission and demodulating received signals. The hearing device further comprises a signal processing unit 12 operatively coupled to the input transducers 26, the signal processing unit 12 being configured to process the microphone signals and create an output signal representing the captured sound and compensating for a frequency dependant hearing loss of the individual user.

The hearing device comprises a power supply 14 provided by a battery, preferably a rechargeable battery. The power source is coupled to a voltage multiplier 32 configured for increasing the voltage of the battery. The voltage multiplier 32 is coupled to the primary voltage source 14*a*, whereas the secondary voltage source 14*b* is coupled to the power source 14. Thus, the primary voltage source 14*a* has a voltage higher than the battery, while the secondary power source 14*b* has a voltage substantially equal to the battery.

The hearing device 10 comprises an antenna 22, preferably a coil for magnetic induction communication, the antenna 22 being configured for reception and transmission of wireless signals to establish a bidirectional wireless link 200 with another device, preferably another hearing device. The antenna 22 is coupled to an RX system for receiving signals vie the wireless link 200 and a TX system for transmitting signals via the wireless link 200.

The RX system comprises an amplifier 28 for amplifying signals received by the antenna 22 according to the gain level. The RX system further comprises an ADC 30 for converting the received signal into a digital signal, preferably with a resolution of two or more. The RX system further comprises a detector unit 18 for detecting at least one of the RSSI, a bit-error rate, a frame-error rate and/or perform a cyclic redundancy check in order to determine the link quality of the wireless link 200. The detector unit 18 is further configured to provide feedback to the amplifier 28 so that the amplifier may adjust the gain level according to the feedback.

The TX system comprises the antenna driver 34 configured for driving signal going from the wireless communication unit 16 to the antenna 22. The antenna driver 34 is selectively coupled to either the primary voltage source 14*a* or the secondary voltage source 14*b* depending on which of the regular power mode or low power mode the hearing device 10 is operating in. The power mode to be operated is chosen based on the quality indicator, which may be measured by the detector unit 18 or received from the other device coupled to the hearing device 10 via the wireless link 200.

Figure 6:
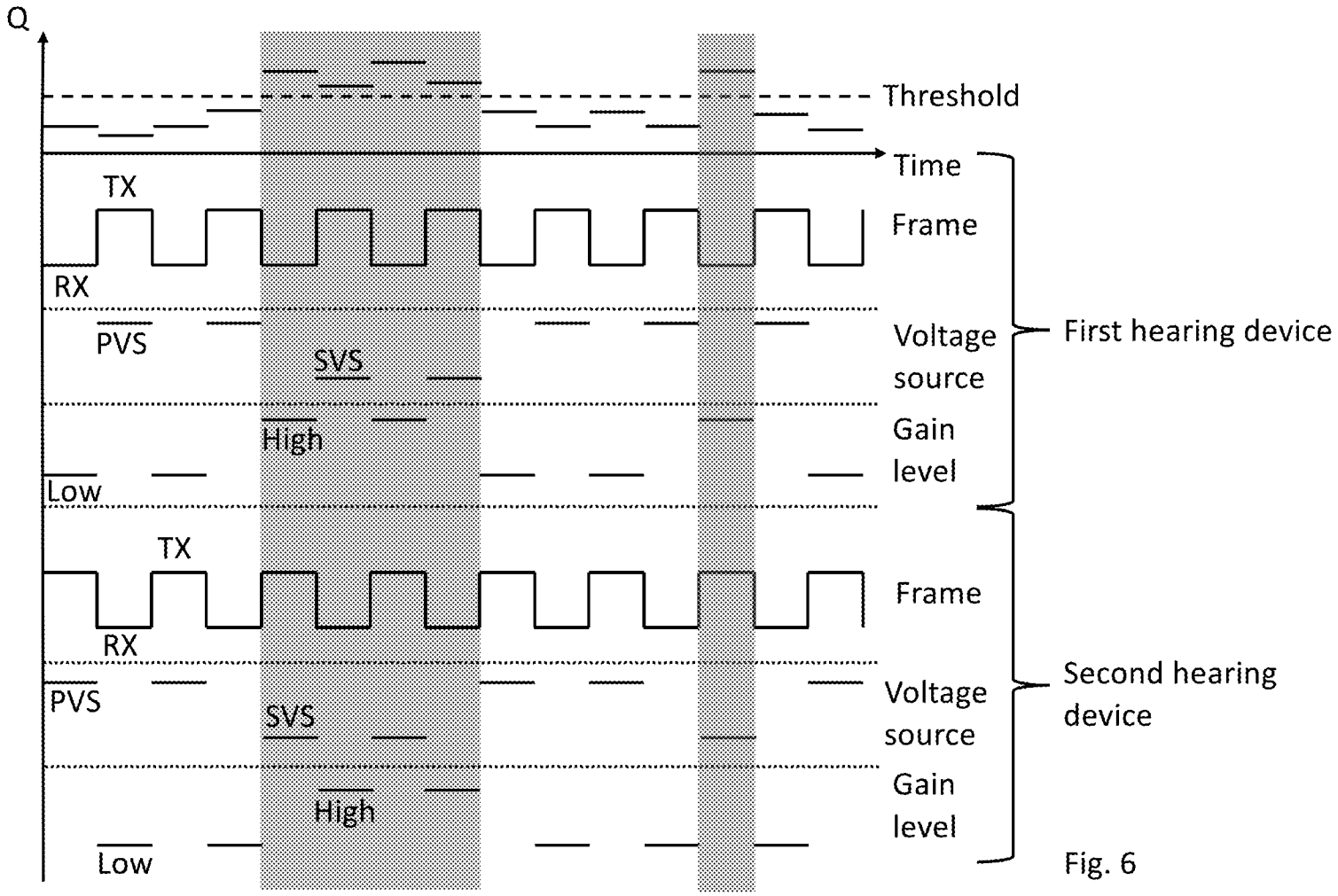
FIG. 6 shows a possible communication scenario between two wireless hearing devices according to some embodiments.

FIG. 6 shows a possible communication scenario in a TDM scheme between two wireless hearing devices according to some embodiments. The upper graph shows the quality indicator in relation to the threshold, while the two lower parts indicate the frame (RX or TX), Voltage source used to drive the antenna, and gain level of the amplifier of the first and second hearing devices, respectively. The X-axis show time.

When the quality indicator is above the threshold, i.e., when the wireless link 200 is strong, the hearing device system 100 operates in the low power mode as can be seen in the grey marked zones. This means that the first and second hearing devices 10R, 10L uses the secondary power source (SVS) 14B to drive their respective antennas 22 in their TX frames, and likewise increases the gain level of their respective amplifiers 28 in their RX frames.

When the quality indicator is below the threshold, i.e. when the wireless link 200 is weak, the hearing device system 100 operates in the regular power mode. This means that the first and second hearing devices 10R, 10L uses the primary power source (PVS) 14A to drive their respective antennas 22 in their TX frames, and likewise decreases the gain level of their respective amplifiers 28 in their RX frames.

Figure 7:
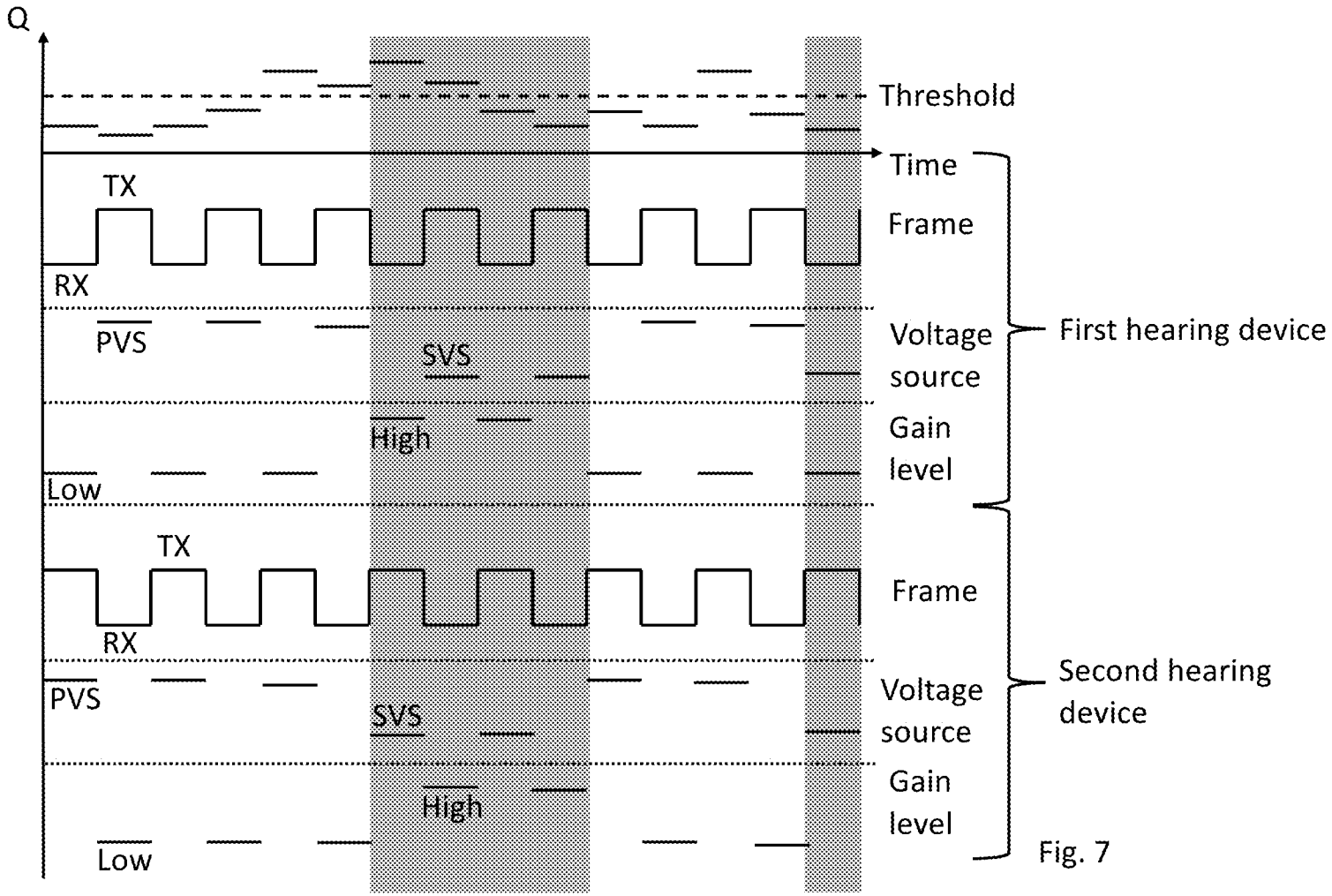
FIG. 7 shows a possible communication scenario between two wireless hearing devices according to some embodiments.

FIG. 7 shows a communication scenario in a TDM scheme similar to that of FIG. 6. In the shown scheme, the changes between low and regular power mode are delayed two frames. This is because, in the shown embodiment, a hearing device 10R or 10L will detect a quality indicator above the threshold, during its RX frame, and subsequently transmit this information, in the form of quality or information data, during its subsequent TX frame. Thus, in the following frame, the transmitting device has received information that it can switch to the secondary power source 14B, while the receiving device can step up its gain level. The update to the power mode can be times with the change in time frame. This embodiment may be updated by including countdown data, thereby allowing the hearing devices 10R, 10L to plan a switch in power mode several frames in advance.

Figure 8:
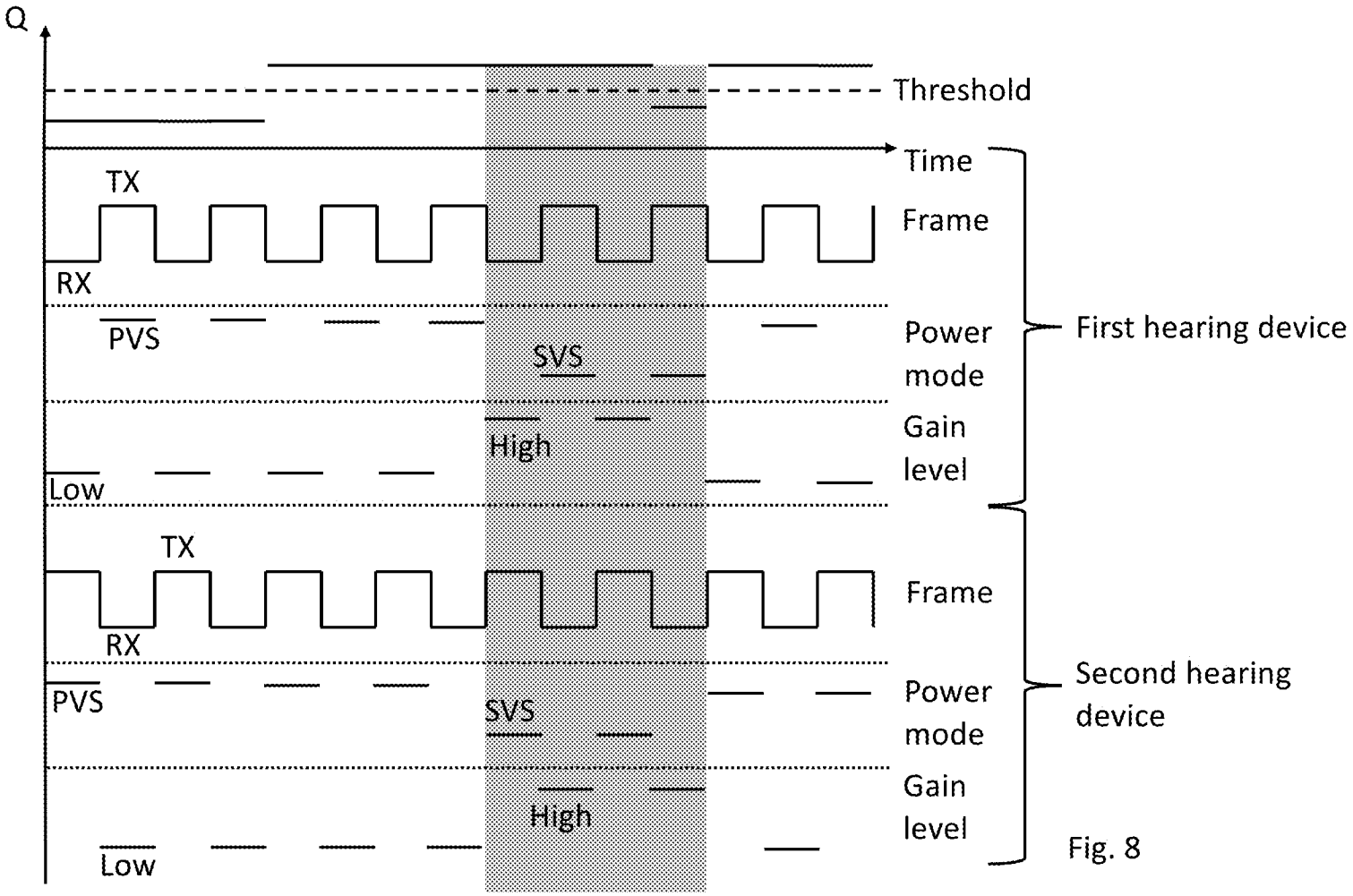
FIG. 8 shows a possible communication scenario between two wireless hearing devices according to some embodiments.

FIG. 8 shows a possible communication scenario in a TDM scheme between two wireless hearing devices according to some embodiments. In the shown embodiment, the quality indicator is determined to be above the threshold only if the strength of the wireless link 200 has been consistently strong over multiple frames, four in the shown embodiment. This ensures excessive switching between the power modes. Although a low-quality indicator could be determined in the same manner, the shown embodiment is configured to switch to the regular power mode after a single frame has occurred. This reduces package loss/data corruption as the hearing device system 100 will adapt to a loss in wireless link strength quicker.

Conceptually the algorithm for adapting TX voltage and gain level can be expressed with the following pseudo code:

If TX is driven by the primary voltage source at transmitting device:

If the quality indicator at receiving device is larger than the threshold:

Go to the secondary voltage source at transmitting device;

Step up the gain of the amplifier on at the receiving device at the same time.

If TX is running on the secondary voltage source at transmitting device:

If the quality indicator at the receiving device is lower than the threshold or, optional, if the Cyclic Redundancy Check (CRC) of mirror frames has failed several times in a row:

Switch to the primary voltage source at transmitting device;

Step down the gain level of the amplifier at the receiving device at the same time.

Two mechanisms are needed in order to implement such algorithm:

1. Monitoring of the quality indicator on the opposite side or receive instructions from opposite side.

2. Simultaneous change of voltage source and gain of the amplifier on both sides.

(1) Can be handled by configuring the hearing devices 10R, 10L to exchange quality data and/or instruction data.

(2) Can be handled by synchronizing the update of AGC and TX voltage source. This can be done by exchanging countdown data or by updating the gain level and the voltage source at a preset time from the transition of quality and/or instruction data. These options will allow simultaneous update without imposing very strict real-time requirements on the commands.

It is advantageous for a hearing device 10L, 10R that is switching power mode to signal this change some time in advance to the opposite hearing device. This may be achieved by configuring the hearing devices 10L, 10R to exchange countdown data indicating an upcoming update in power mode. It is advantageous to have a multiple bit, e.g. a 4-bit, field in the mirror indicating the next mode, e.g. 1 bit indicating $0=V_{primary}$ (primary voltage source); $1=V_{secondary}$ (secondary voltage source), and a countdown value indicating the number of frames until the change will be effectuated, e.g. 3 bits.

Examples

A device running on $V_{secondary}$ already will indicate 0b1000 (1: $V_{secondary}$, 000: Timeout expired) indicating no change in power mode.

A device wanting to update to $V_{primary}$ will go through the sequence 0b0111, 0b0110, 0b0101 0b0001, 0b0000 to indicate that the change is upcoming. The receiving side will then only need one of these 8 frames to be correct to deduce when to issue an update to sync with the update.

For a mirror size of 20 bytes in low-latency mode this update will then take (768[us]*(2+20)[frames]*8[countdown])=135 ms to execute. For this system, it would be advantageous to have the integration time of the detector unit 18 in the order of seconds to avoid the hearing device system 100 switching power mode constantly.

Example hearing device systems, methods, and hearing devices according to the present disclosure are given in the items below.

Item 1. A wireless binaural hearing device system comprising:

a first and a second hearing device for placement at and/or in a user's first and second ear, respectively, each hearing device comprising an output transducer for providing an output to the user, a wireless communication unit and an antenna adapted for providing a wireless link between the first and the second hearing devices, an amplifier configured for amplifying signals received via the wireless link according to a gain level, and a power supply having a primary voltage source and a secondary voltage source, wherein the secondary voltage source provides a lower voltage than the primary voltage source; and a detector arrangement adapted for determining a quality indicator indicative of the quality of the wireless link;

a control arrangement adapted to:

switch to a low power mode when the quality indicator is above a threshold, in which a transmitting hearing device of the first and second hearing devices uses its secondary voltage source to drive transmission with its antenna, and synchronously increase the gain level of a receiving device of the first and second hearing devices, and switch to a regular power mode when the quality indicator is below the threshold, in which regular power mode the transmitting hearing device uses its primary voltage source to drive transmission with its antenna, and preferably synchronously decrease the gain level of the receiving device.

Item 2. The hearing device system of item 1, wherein the hearing device system is adapted to transmit a switching signal via the wireless link, the switching signal comprising at least one of:

quality data including and/or based on the quality indicator, instruction data comprising instructions to switch to the low power mode or the regular power mode or to change the gain level, or countdown data indicating the timing of an upcoming switch in power mode.

Item 3. The hearing device system of item 2, wherein the countdown data comprises two or more bits.

Item 4. The hearing device system of items 2 or 3, wherein the hearing device system is adapted to transmit the switching signal multiple times.

Item 5. The hearing device system of claim 4, wherein the countdown data is updated for each transmission of the switching signal.

Item 6. A method of operating a wireless binaural hearing device system comprising a first and a second hearing device for placement at and/or in a user's first and second ear, respectively, each hearing device comprising an output transducer for providing an output to the user, a wireless communication unit and an antenna adapted for providing a wireless link between the first and the second hearing devices, an amplifier configured for amplifying signals received via the wireless link according to a gain level, and a power supply having a primary voltage source and a secondary voltage source, wherein the secondary voltage source provides a lower voltage than the primary voltage source, the method comprising the steps of:

determining a quality indicator indicative of the quality of the wireless link; and switching to:

a low power mode when the quality indicator is above a threshold, in which a transmitting hearing device of the first and second hearing devices uses its secondary voltage source to drive transmission with its antenna, and synchronously increase the gain level of the amplifier of a receiving device of the first and second hearing devices, or a regular power mode when the quality indicator is below the threshold, in which regular power mode the transmitting hearing device uses its primary voltage source to drive transmission with its antenna, and preferably synchronously decrease the gain level of the amplifier of the receiving device.

Item 7. The method of item 6 further comprising the step of transmitting a switching signal via the wireless link, the switching signal comprising at least one of:

quality data including and/or based on the quality indicator, instruction data comprising instructions to switch to the low power mode or the regular power mode or to change the gain level, or countdown data indicating the timing of an upcoming switch in power mode.

Item 8. The method of item 7, wherein the countdown data comprises two or more bits.

Item 9. The method of items 7 or 8, wherein the step of transmitting the switching signals is repeated.

Item 10. The method of item 9, wherein the countdown data is updated for each transmission of the switching signal.

Item 11. A wireless hearing device for placement at and/or in a user's ear, the hearing device comprising:

an output transducer for providing an output to the user;

a wireless communication unit and an antenna adapted for providing a wireless link between the hearing device and an external device;

an amplifier configured for amplifying signals received via the wireless link according to a gain level;

a power supply having a primary voltage source and a secondary voltage source, wherein the secondary voltage source provides a lower voltage than the primary voltage source;

a detector unit adapted for determining a quality indicator indicative of the quality of the wireless link; and a control unit adapted to operate the hearing device in:

when the quality indicator is above a threshold, a low power mode in which the secondary voltage source is used to drive transmission with the antenna, and when the quality indicator is below the threshold, a regular power mode in which the primary voltage source is used to drive transmission with the antenna, characterized in that the hearing device is adapted for, before switching to the low power mode, transmitting a switching signal comprising information of the switch to low power mode via the wireless link, and preferably adapted for, before switching to the regular power mode, transmitting a second switching signal comprising information of the switch to regular power mode via the wireless link.

Item 12. The hearing device of item 11, wherein the switching signal comprises at least one of:

quality data including and/or based on the quality indicator, instruction data comprising instructions to switch to the low power mode or the regular power mode or to change the gain level, or countdown data indicating the timing of an upcoming switch in power mode.

Item 13. The hearing device of item 12, wherein the countdown data comprises two or more bits.

Item 14. The hearing device of items 12 or 13, wherein the hearing device is adapted to transmit the switching signal multiple times.

Item 15. The hearing device of item 14, wherein the countdown data is updated for each transmission of the switching signal.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly, to be regarded in an illustrative rather than restrictive sense. The claimed invention is intended to cover all alternatives, modifications, and equivalents.

LIST OF REFERENCES

10 Hearing device
10R First hearing device
10L Second hearing device
12 Signal processing unit
12R Signal processing unit of the first hearing device
12L Signal processing unit of the second hearing device
14 Power supply
14*a* Primary voltage source
14*b* Secondary voltage source
14R Power supply of the first hearing device
14Ra Primary voltage source of the first hearing device
14Rb Secondary voltage source of the first hearing device
14L Power supply of the second hearing device
14La Primary voltage source of the second hearing device
14Lb Secondary voltage source of the second hearing device
16 Wireless communication unit
16R Wireless communication unit of the first hearing device
16L Wireless communication unit of the second hearing device
18 Detector arrangement
18R Detector unit of the first hearing device
18L Detector unit of the second hearing device
20 Control unit
20R Control unit of the first hearing device
20L Control unit of the second hearing device
22 Antenna
22R Antenna of the first hearing device
22L Antenna of the second hearing device
24 Output transducer
24R Output transducer of the first hearing device
24L Output transducer of the second hearing device
26 Input transducer
26R Input transducer of the first hearing device
26L Input transducer of the second hearing device
28 Amplifier
30 Analogue to digital converter (ADC)
32 Voltage multiplier
34 Antenna driver
100 Hearing device system
200 Wireless link

The invention claimed is:

1. A binaural hearing device system comprising:

a first hearing device and a second hearing device for placement at and/or in a user's first ear and second ear, respectively, each of the first and second hearing devices comprising an output transducer for providing an output to the user, a wireless communication unit and an antenna configured to provide a wireless link between the first and the second hearing devices, an amplifier configured to amplify signals received via the wireless link according to a gain level, and a power supply having a primary voltage source and a secondary voltage source, wherein the secondary voltage source is configured to provide a lower voltage than the primary voltage source;

a detector arrangement configured to determine a quality indicator indicative of a quality of the wireless link; and a control arrangement;

wherein the control arrangement is configured to switch the binaural hearing system to be in a first power mode when the quality indicator is above a threshold, wherein in the first power mode, one of the first and second hearing device is configured to use its secondary voltage source to drive transmission with its antenna, and the gain level of the other one of the first and second hearing devices is synchronously increased, wherein the control arrangement is configured to switch the binaural hearing system to be in a second power mode when the quality indicator is below the threshold, wherein in the second power mode, one of the first and second hearing devices is configured to use its primary voltage source to drive transmission with its antenna; wherein the binaural hearing device system is configured to transmit a switching signal via the wireless link, the switching signal comprising at least one of:

quality data including and/or based on the quality indicator, instruction data comprising instructions to switch to the first power mode or the second power mode, or to change the gain level of one of the first and second hearing devices, or countdown data indicating a timing of an upcoming power mode switch, wherein the countdown data comprises two or more bits.

2. The binaural hearing device system of claim 1, wherein the binaural hearing device system is configured to transmit the switching signal multiple times.

3. The binaural hearing device system of claim 1, wherein the first hearing device comprises a hearing aid.

4. The binaural hearing device system of claim 1, wherein the first hearing device comprises an earbud.

5. A binaural hearing device system comprising:

a first hearing device and a second hearing device for placement at and/or in a user's first ear and second ear, respectively, each of the first and second hearing devices comprising an output transducer for providing an output to the user, a wireless communication unit and an antenna configured to provide a wireless link between the first and the second hearing devices, an amplifier configured to amplify signals received via the wireless link according to a gain level, and a power supply having a primary voltage source and a secondary voltage source, wherein the secondary voltage source is configured to provide a lower voltage than the primary voltage source;

a detector arrangement configured to determine a quality indicator indicative of a quality of the wireless link; and a control arrangement;

wherein the control arrangement is configured to switch the binaural hearing system to be in a first power mode when the quality indicator is above a threshold, wherein in the first power mode, one of the first and second hearing device is configured to use its secondary voltage source to drive transmission with its antenna, and the gain level of the other one of the first and second hearing devices is synchronously increased;

wherein the control arrangement is configured to switch the binaural hearing system to be in a second power mode when the quality indicator is below the threshold, wherein in the second power mode, one of the first and second hearing devices is configured to use its primary voltage source to drive transmission with its antenna;

wherein the binaural hearing device system is configured to transmit a switching signal via the wireless link, the switching signal comprising at least one of:

quality data including and/or based on the quality indicator, instruction data comprising instructions to switch to the first power mode or the second power mode, or to change the gain level of one of the first and second hearing devices, or countdown data indicating a timing of an upcoming power mode switch;

wherein the binaural hearing device system is configured to transmit the switching signal multiple times; and wherein the binaural hearing device system is configured to update the countdown data for each of the transmissions of the switching signal.

6. A method of operating a wireless binaural hearing device system comprising a first hearing device and a second hearing device for placement at and/or in a user's first ear and second ear, respectively, each of the first and second hearing devices comprising an output transducer configured to provide an output to the user, a wireless communication unit, and an antenna configured to provide a wireless link between the first and the second hearing devices, an amplifier configured to amplify signals received via the wireless link according to a gain level, and a power supply having a primary voltage source and a secondary voltage source, wherein the secondary voltage source provides a lower voltage than the primary voltage source, the method comprising:

determining a quality indicator indicative of a quality of the wireless link; and switching to:

a first power mode when the quality indicator is above a threshold, wherein in the first power mode, one of the first and second hearing devices uses its secondary voltage source to drive transmission with its antenna, and the gain level of the other one of the first and second hearing devices is synchronously increased, or a second power mode when the quality indicator is below the threshold, wherein in the second power mode, one of the first and second hearing devices uses its primary voltage source to drive transmission with its antenna;

wherein the method further comprises transmitting a switching signal via the wireless link, the switching signal comprising at least one of:

quality data including and/or based on the quality indicator, instruction data comprising instructions to switch to the first power mode or the second power mode, or to change the gain level of one of the first and second hearing devices, or countdown data indicating a timing of an upcoming power mode switch, wherein the countdown data comprises two or more bits.

7. The method of claim 6, wherein the act of transmitting the switching signal is repeated.

8. The method of claim 6, wherein the first hearing device comprises a hearing aid.

9. The method of claim 6, wherein the first hearing device comprise an earbud.

10. A method of operating a wireless binaural hearing device system comprising a first hearing device and a second hearing device for placement at and/or in a user's first ear and second ear, respectively, each of the first and second hearing devices comprising an output transducer configured to provide an output to the user, a wireless communication unit, and an antenna configured to provide a wireless link between the first and the second hearing devices, an amplifier configured to amplify signals received via the wireless link according to a gain level, and a power supply having a primary voltage source and a secondary voltage source, wherein the secondary voltage source provides a lower voltage than the primary voltage source, the method comprising:

determining a quality indicator indicative of a quality of the wireless link; and switching to:

a first power mode when the quality indicator is above a threshold, wherein in the first power mode, one of the first and second hearing devices uses its secondary voltage source to drive transmission with its antenna, and the gain level of the other one of the first and second hearing devices is synchronously increased, or a second power mode when the quality indicator is below the threshold, wherein in the second power mode, one of the first and second hearing devices uses its primary voltage source to drive transmission with its antenna;

wherein the method further comprises transmitting a switching signal via the wireless link, the switching signal comprising at least one of:

quality data including and/or based on the quality indicator, instruction data comprising instructions to switch to the first power mode or the second power mode, or to change the gain level of one of the first and second hearing devices, or countdown data indicating a timing of an upcoming power mode switch;

wherein the act of transmitting the switching signal is repeated; and wherein the method further comprises updating the countdown data for each of the acts of transmitting the switching signal.

11. A hearing device for placement at and/or in a user's ear, the hearing device comprising:

an output transducer configured to provide an output to the user;

a wireless communication unit and an antenna configured to provide a wireless link between the hearing device and an external device;

an amplifier configured to amplify signals received via the wireless link;

a power supply having a primary voltage source and a secondary voltage source, wherein the secondary voltage source is configured to provide a lower voltage than the primary voltage source;

a detector unit configured to determine a quality indicator indicative of a quality of the wireless link; and a control unit;

wherein the control unit is configured to switch the hearing device to be in a first power mode when the quality indicator is above a threshold, wherein in the first power mode, the hearing device is configured to use the secondary voltage source to drive transmission with the antenna;

wherein the control unit is configured to switch the hearing device to be in a second power mode when the quality indicator is below the threshold, wherein in the second power mode, the hearing device is configured to use the primary voltage source to drive transmission with the antenna;

wherein the hearing device is configured to, before switching to the first power mode, transmit a first switching signal via the wireless link, wherein the first switching signal comprises information regarding the switch to the first power mode;

wherein the first switching signal comprises at least one of:

quality data including and/or based on the quality indicator, instruction data comprising instructions to switch to the first power mode or the second power mode, or to change a gain level, or countdown data indicating a timing of an upcoming power mode switch, wherein the countdown data comprises two or more bits.

12. The hearing device of claim 11, wherein the hearing device is configured to transmit the first switching signal multiple times.

13. The hearing device of claim 11, wherein the hearing device is configured to, before switching to the second power mode, transmit a second switching signal via the wireless link, wherein the second switching signal comprises information regarding the switch to the second power mode.

14. The hearing device of claim 11, wherein the hearing device is a hearing aid.

15. The hearing device of claim 11, wherein the hearing device is an earbud.

16. A hearing device for placement at and/or in a user's ear, the hearing device comprising:

an output transducer configured to provide an output to the user;

a wireless communication unit and an antenna configured to provide a wireless link between the hearing device and an external device;

an amplifier configured to amplify signals received via the wireless link;

a power supply having a primary voltage source and a secondary voltage source, wherein the secondary voltage source is configured to provide a lower voltage than the primary voltage source;

a detector unit configured to determine a quality indicator indicative of a quality of the wireless link; and a control unit;

wherein the control unit is configured to switch the hearing device to be in a first power mode when the quality indicator is above a threshold, wherein in the first power mode, the hearing device is configured to use the secondary voltage source to drive transmission with the antenna;

wherein the control unit is configured to switch the hearing device to be in a second power mode when the quality indicator is below the threshold, wherein in the second power mode, the hearing device is configured to use the primary voltage source to drive transmission with the antenna;

wherein the hearing device is configured to, before switching to the first power mode, transmit a first switching signal via the wireless link, wherein the first switching signal comprises information regarding the switch to the first power mode;

wherein the hearing device is configured to transmit the first switching signal multiple times; and wherein the hearing device is configured to update a countdown data for each of the transmissions of the first switching signal.

17. The hearing device of claim 16, wherein the first switching signal comprises at least one of:

quality data including and/or based on the quality indicator, instruction data comprising instructions to switch to the first power mode or the second power mode, or to change a gain level, or the countdown data.

18. The hearing device of claim 16, wherein the hearing device is configured to, before switching to the second power mode, transmit a second switching signal via the wireless link, wherein the second switching signal comprises information regarding the switch to the second power mode.

19. The hearing device of claim 16, wherein the hearing device is a hearing aid.

20. The hearing device of claim 16, wherein the hearing device is an earbud.

* * * * *